US008627962B2

(12) United States Patent
Cappozzo

(10) Patent No.: US 8,627,962 B2
(45) Date of Patent: Jan. 14, 2014

(54) SCREEN FOR SEPARATING SOLID MATERIALS

(75) Inventor: Domenico Cappozzo, Sandrigo (IT)

(73) Assignee: Ecostar s.r.l., Sandrigo (VI) (IT)

( * ) Notice: Subject to any disclaimer, the term of this patent is extended or adjusted under 35 U.S.C. 154(b) by 0 days.

(21) Appl. No.: 13/497,046

(22) PCT Filed: Oct. 13, 2010

(86) PCT No.: PCT/IB2010/002610

§ 371 (c)(1),
(2), (4) Date: May 4, 2012

(87) PCT Pub. No.: WO2011/045656

PCT Pub. Date: Apr. 21, 2011

(65) Prior Publication Data

US 2012/0325729 A1 Dec. 27, 2012

(30) Foreign Application Priority Data

Oct. 14, 2009 (IT) ..... VI2009A0249

(51) Int. Cl.
*B07B 13/00* (2006.01)
*B07C 5/12* (2006.01)

(52) U.S. Cl.
USPC ..... 209/672; 209/667

(58) Field of Classification Search
USPC ..... 209/660, 667, 672
See application file for complete search history.

(56) References Cited

U.S. PATENT DOCUMENTS 5,480,034 A * 1/1996 Kobayashi ..... 209/667
5,626,239 A * 5/1997 Kobayashi ..... 209/667

FOREIGN PATENT DOCUMENTS

EP 1106264 B1 * 1/2005

* cited by examiner

*Primary Examiner* — David H Bollinger
(74) *Attorney, Agent, or Firm* — IP Strategies

(57) ABSTRACT

The invention is a screen (1) for separating solid residues, comprising: a plurality of parallel rotary shafts (2) spaced from each other and associated with a supporting structure (3); drive means (4, 4*a*) of the shafts (2) suited to set them rotating around their longitudinal axis (Y); a plurality of screening discs (8) arranged spaced from each other along the rotary shafts (2) to which they are fixed through connection means (9); a plurality of anti-clogging sleeves (10; 20) coupled externally to the rotary shafts (2) and each included between two corresponding screening discs (8). A stabilizing body (11, 21) is arranged peripherally inside each one of the anti-clogging sleeves (10, 20).

11 Claims, 7 Drawing Sheets

SCREEN FOR SEPARATING SOLID MATERIALS

FIELD OF THE INVENTION

The invention concerns a perfected screen of the type suited for separating solid materials of various kinds.

In particular, the screen that is the subject of the invention is used in the sector of solid residue treatment in general and it is preferably but not exclusively installed downstream of devices for crushing and grinding the residues.

In particular, the screen that is the subject of the invention is suited to be used for screening any type of residue, including solid urban waste.

It should be noted that in the following description the term "residue" will be used to indicate any type of solid material, including solid urban waste.

BACKGROUND OF THE INVENTION

Various types of screen are available on the market that are suited to be used in the sector of solid residue separation and are produced in different construction forms that operate according to different principles.

A known type of screen is constituted by the so-called "mesh screens" that comprise a supporting structure provided with a grid, along which the residues to be screened advance owing to the action of suitable moving means.

The grid consists of meshes with increasing cross section along the direction of advance of the residues, which are thus screened due to gravity during the advance, starting from the smaller-sized residues that fall under the grid in its initial section and proceeding until the larger-sized residues fall down at the level of the final section.

The screens of this type, however, pose a first recognized drawback represented by the fact that the grid wears out over time as the residues scrape against it and therefore must be replaced from time to time.

"Disc screens" are also known which comprise a supporting structure for a plurality of discs mounted on parallel rotary shafts.

The discs mounted on each rotary shaft are spaced from each other by a distance exceeding the thickness of each disc and therefore each disc of any of the rotary shafts is included between two discs of the adjacent shaft.

A screening surface is thus defined, in which the size of the openings created between the discs and the rotary shafts determines the degree of screening of the residues whose advance along the screening surface is determined by the rotation of the discs.

A disc screen of the type mentioned above is described in U.S. Pat. No. 4,972,959 and comprises a supporting structure of a series of parallel spaced shafts rotating in the same direction and supporting a plurality of discs. Also in this case a screening surface is defined, in which the rotation of the discs causes the advance of the residues that are thus screened according to the size of the openings defined between the discs and the shafts and fall under the screening surface due to gravity.

As each disc is coupled with the corresponding shaft through the interposition of elastic spacer sleeves, the discs may bend and deviate from their rotation plane if during screening any foreign matter should get stuck between them.

A disc screen is described also in Patent DE-U-297 11 724 and comprises a supporting structure associated with a plurality of rotating rollers arranged with their rotation axes parallel to each other and spaced by increasing distances according to the advance direction of the residues.

The rollers are connected to a plurality of discs arranged at a constant distance from each other, thus defining also in this case a screening surface constituted by the interspaces existing between the rollers and the discs.

All the rollers and therefore also the discs associated with them are set rotating at the same time and in the same direction so that the residue to be screened that is placed in the initial area is pushed forward by the rotation of the discs.

In this way, as the residues advance they are screened due to gravity, in fact the smaller-sized parts fall in the space between the discs.

Also the "disc screens" described above, however, pose some recognized drawbacks, the main of which lies in that their operation is easily affected or even prevented when among the residues to be screened there are filiform elements like rags, plastic bags, radio and video tapes, and similar elements.

In fact, this type of residues with mainly longitudinal development, which is frequently found among the residues when these are constituted by solid urban waste, tends to get twisted around the rollers and the shafts and to clog the spaces between the discs, thus affecting the screening operation and causing machine stoppages.

The user is thus forced to carry out frequent cleaning operations that are rather expensive because, among other things, they must be performed with the system at rest.

For these reasons "disc screens" have met with little success in the sector of solid residue screening.

In the attempt to overcome these drawbacks, the applicant of the present invention has registered in its own name the European Patent EP 1 106 264 that describes a screen for separating solid urban waste of the type with discs, provided with anti-clogging sleeves, useful above all when among the residues there are filiform elements.

According to the above mentioned patent, the screen comprises a supporting structure for a plurality of parallel and spaced rotary shafts, each one of which is provided with a plurality of discs, axially spaced from each other, between which a plurality of the so-called anti-clogging sleeves is provided.

With reference to FIG. 6, which illustrates a detail of the screen that is the subject of the above mentioned patent, between each disc indicated by A and the disc adjacent to it, not represented, there is an anti-clogging element indicated as a whole by B.

As can be observed, the anti-clogging sleeve comprises a cylindrical tube C externally coupled with the corresponding shaft D and having its inner diameter Ci that is longer than the outer diameter De of the shaft D and the length E shorter than the distance between the discs A.

Each cylindrical tube C is thus coupled with the corresponding shaft D with a play F and can rotate freely and translate radially in relation to it, both when the shaft D is at rest and when it is rotating.

In this way, if filiform residues get twisted around one or more cylindrical tubes C and increase their diameters until they come into contact with the opposing discs A, this does not affect the operation of the screen in any way and, most important of all, does not stop it.

In fact, each cylindrical tube C, being idle in relation to the shaft D with which it is coupled, is set rotating due to the friction that the residue twisted around it exerts against the discs A, substantially without absorbing power and therefore without interfering with the rotation of the shafts D.

Furthermore, the presence of said anti-clogging sleeves free to move between the discs favours the work of the operator when he/she has to intervene in order to remove any twisted filiform element from around the shafts and discs. Said sleeves, however, serve only partially the preventive anti-clogging function for which they are intended, that is, the function of limiting or in any case preventing the twisting of said filiform elements.

In fact, repeated observations have made it possible to find out that during the operation of the screen the anti-clogging sleeves are easily set rotating by the filiform elements present in the residues and this favours the twisting of said filiform elements.

BRIEF SUMMARY OF THE INVENTION

The present invention has been designed to eliminate or at least drastically reduce this last drawback.

In particular, it is a first object of the present invention to provide a screen that compared to the screens of known type available on the market is less liable to get clogged due to the twisting of filiform elements around its operational members.

It is a further object of the present invention to provide a screen that in case of stoppage due to clogging caused by the twisting of filiform elements can be easily cleared and brought back to its correct operating condition.

The objects described above are achieved by a perfected disc screen having the characteristics described in the main claim, to which the reader should refer for the sake of brevity.

Other details of the invention are described in the dependent claims.

The disc screen that is the subject of the invention advantageously offers more reliable operation compared to the disc screens of known type, especially for screening solid waste containing filiform elements.

Still advantageously, said greater reliability means fewer standstills for maintenance and/or cleaning operations and therefore also lower operating costs.

BRIEF DESCRIPTION OF THE DRAWINGS

The aims and advantages mentioned above will be better highlighted in the description of preferred embodiments of the screen that is the subject of the invention, which are described with reference to the attached drawings, in which.

DETAILED DESCRIPTION OF THE INVENTION

Figure 1:
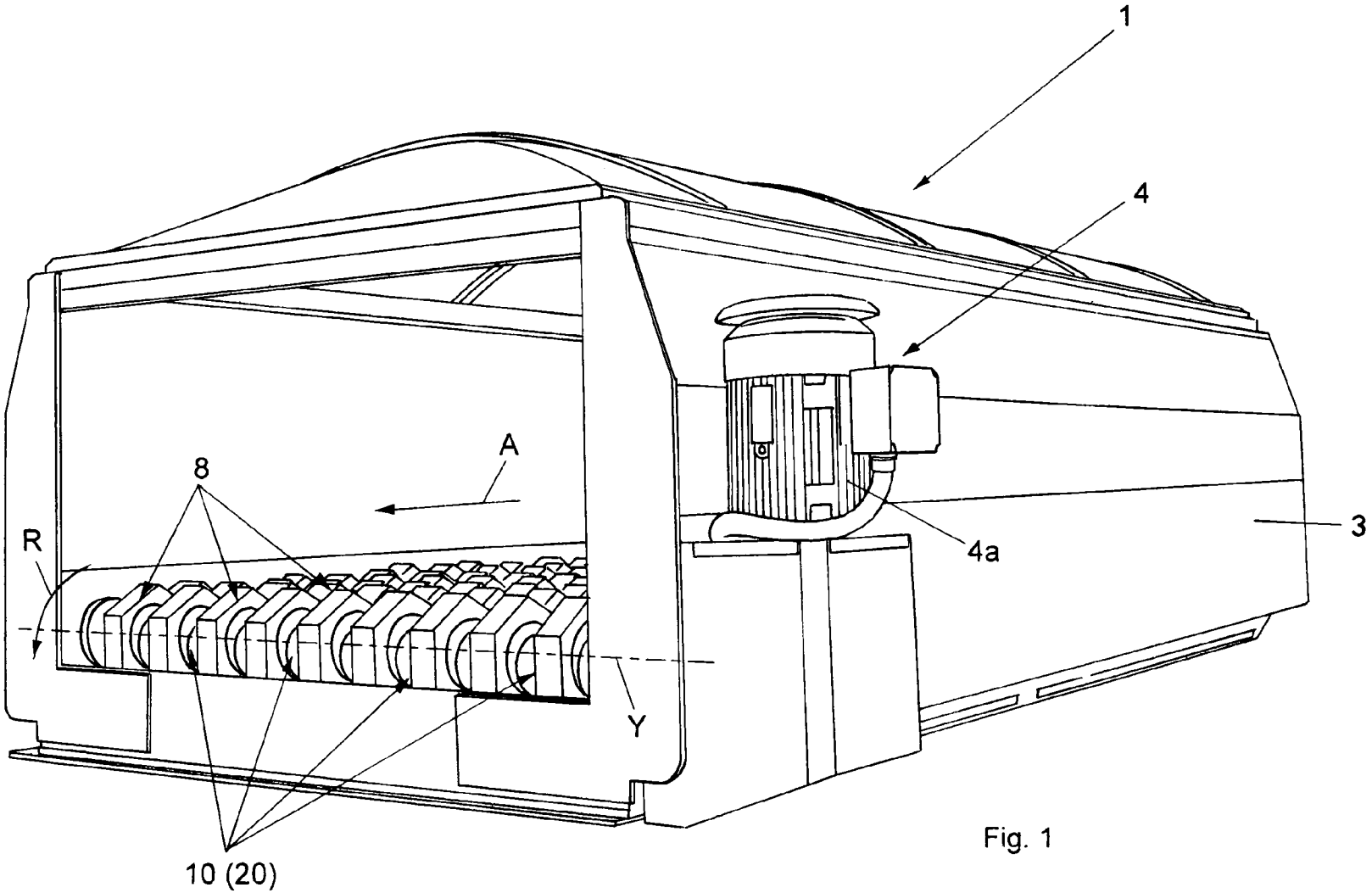
FIG. 1 shows an axonometric view of the disc screen that is the subject of the invention.
Figure 2:
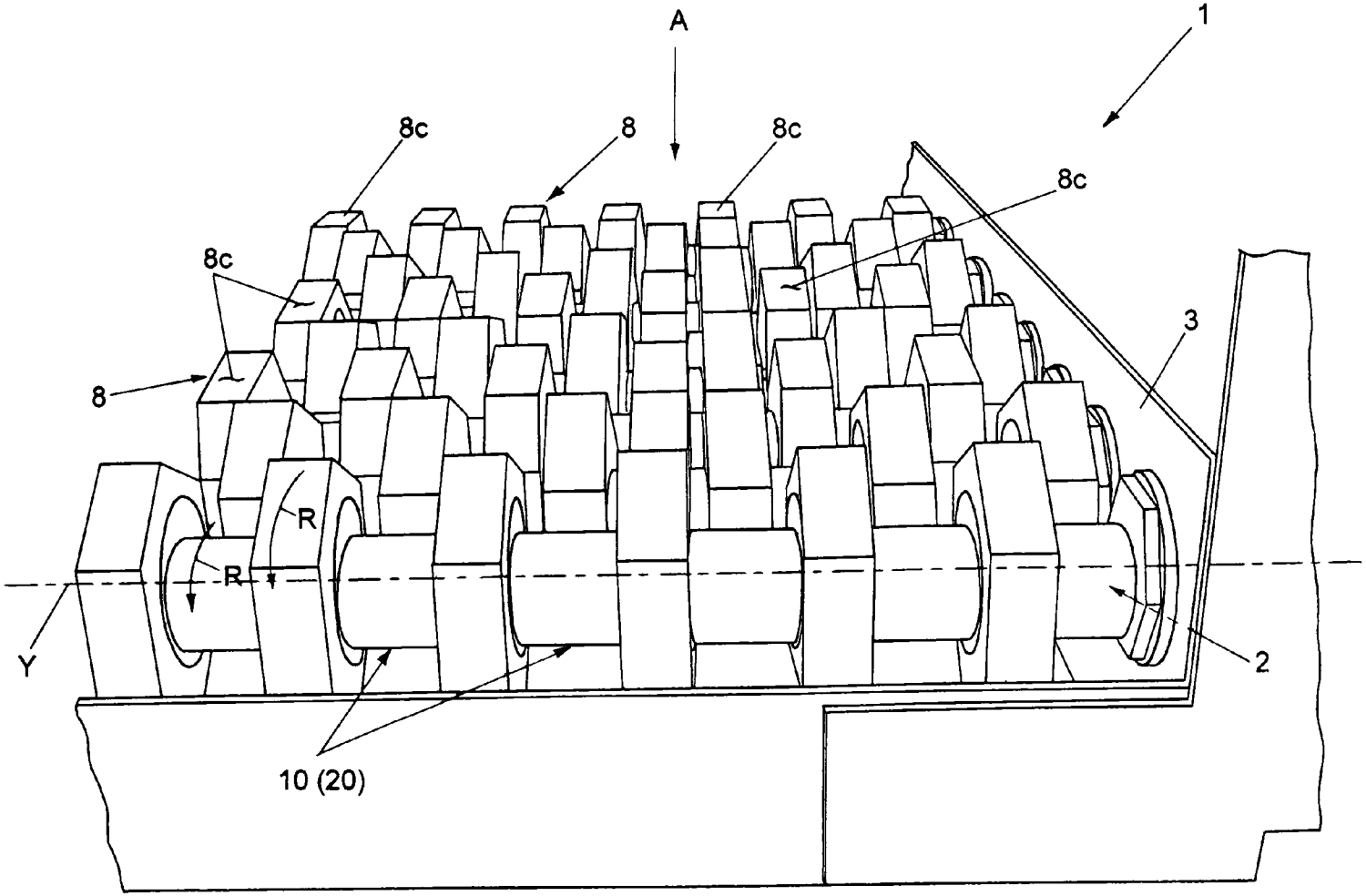
FIG. 2 shows an enlarged detail of FIG. 1.
Figure 3:
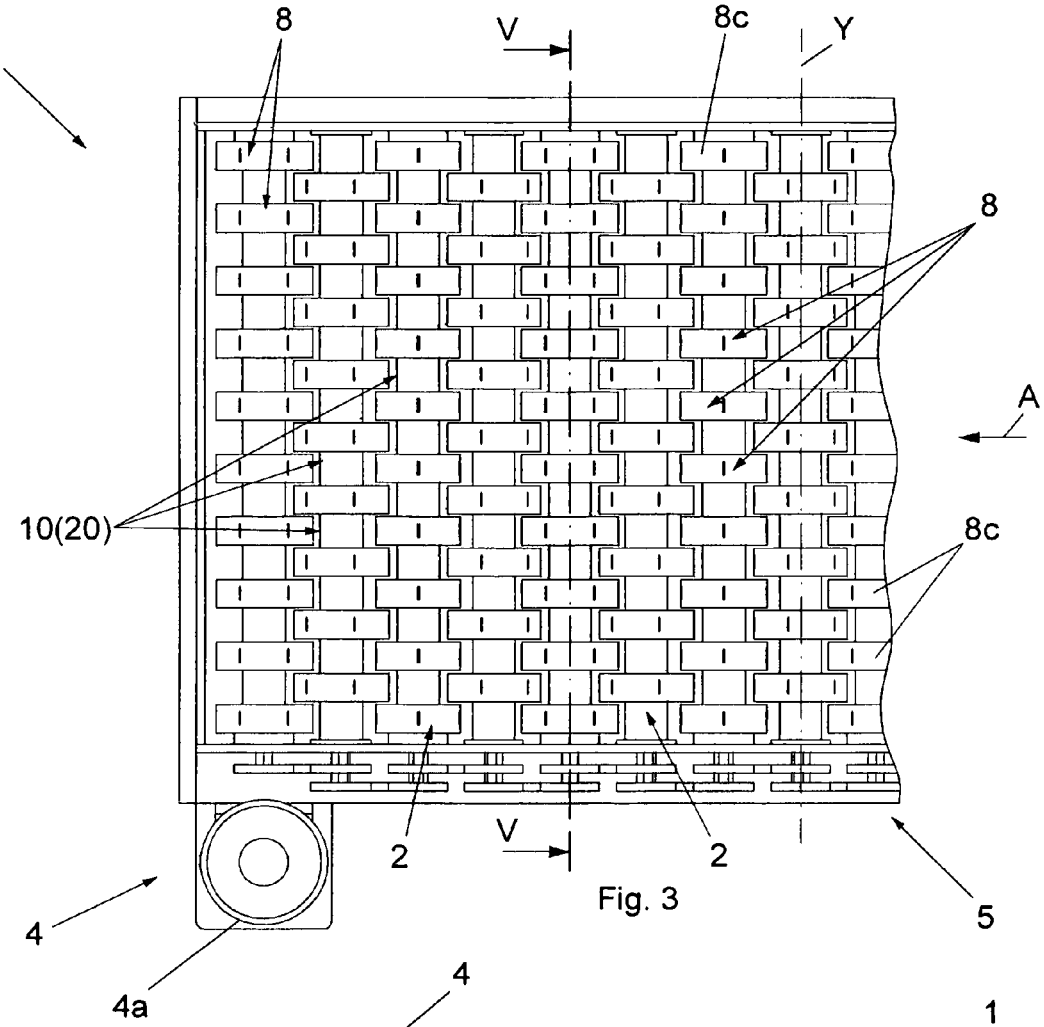
FIG. 3 shows a plan view of the screen shown in FIG. 1.
Figure 4:
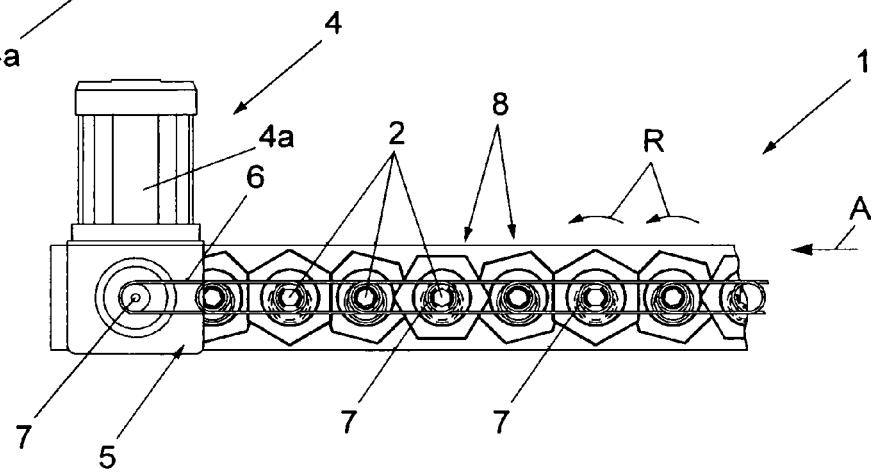
FIG. 4 shows a side view of the screen shown in FIG. 1.

The perfected screen that is the subject of the invention is shown in the axonometric views of FIG. 1 and FIG. 2 and in the plan and side views of FIG. 3 and FIG. 4, respectively, where it is indicated as a whole by 1.

It can be observed that it comprises a plurality of rotary shafts 2 that are parallel to and spaced from each other, associated with a supporting structure 3 that arranges the longitudinal axes Y of the rotary shafts 2 preferably but not necessarily according to a configuration that defines a substantially horizontal plane.

However, the invention does not exclude a configuration of the supporting structure that makes it possible to arrange the longitudinal axes of the rotary shafts according to an inclined plane, or on two or more planes that may even be concurrent, or even according to a surface with curved profile.

Drive means 4 are provided, preferably consisting of an electric motor **4*a* which can be seen in FIGS. 1, 3 and 4 and which, through a kinematic mechanism 5 comprising a chain 6 wound as a closed ring and meshing with pinions 7 belonging to the motor 4*a* and to each rotary shaft 2, sets all the rotary shafts 2** rotating according to the same rotation direction R indicated by the arrow.

It is evident that the drive means for the rotation of the rotary shafts can be of any other type.

The rotary shafts 2 are coupled with a plurality of screening discs 8 that are spaced from each other according to the longitudinal axis Y of the rotary shaft 2 to which they belong and to which they are fixed through connection means 9.

Preferably, each screening disc 8 has the shape of an hexagonal prism with six plane sides **8*c* that favour the advance of the residues to be screened during the rotation of the shafts 2**.

Furthermore, outside each rotary shaft 2 there is a plurality of anti-clogging sleeves 10, each one of which is included between two corresponding screening discs 8.

According to the invention, a stabilizing body 11 is arranged peripherally inside each one of the anti-clogging sleeves 10.

Figure 5:
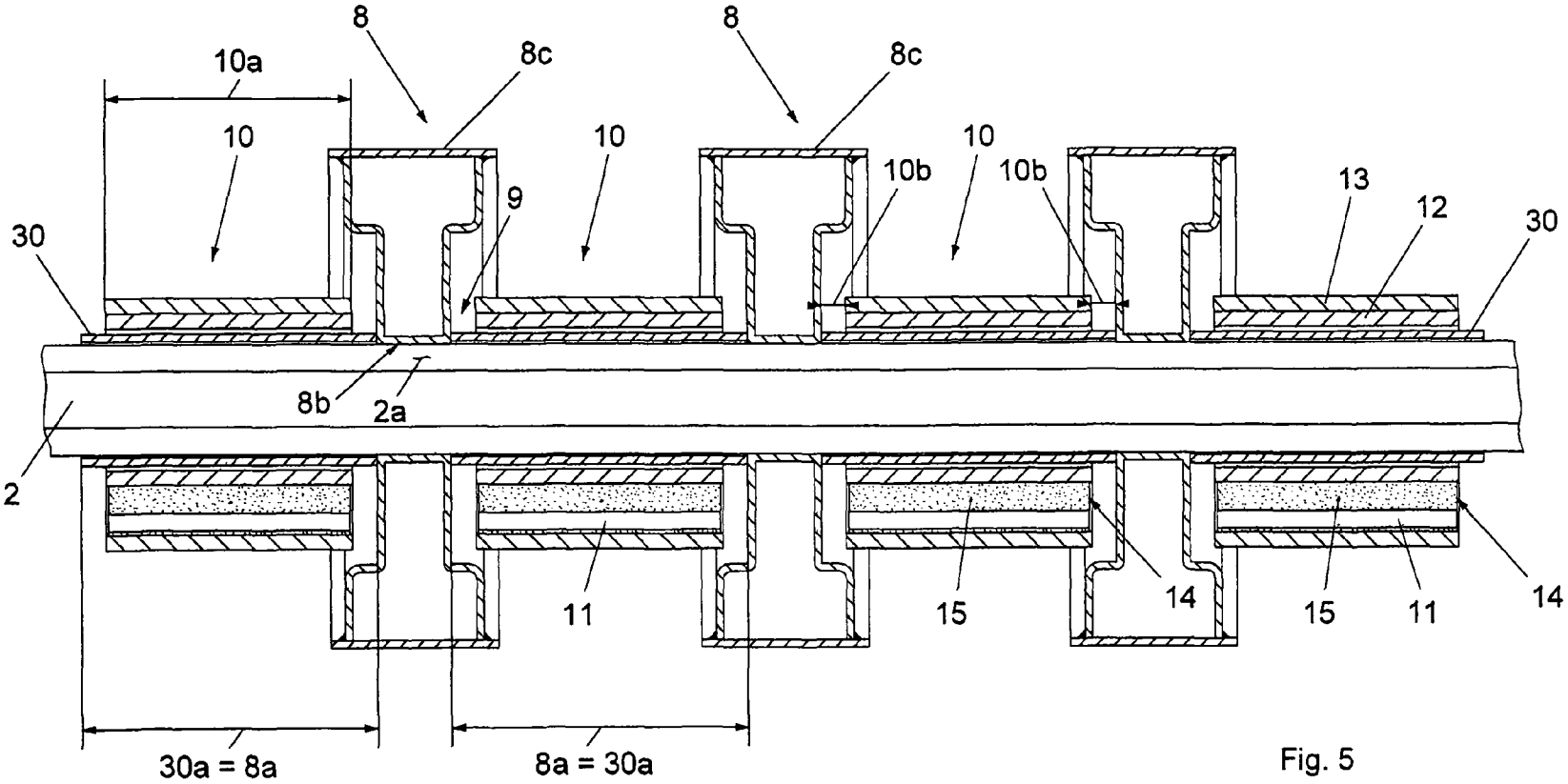
FIG. 5 shows an enlarged view of the section of FIG. 3 carried out according to the vertical plane V-V.
Figure 6:
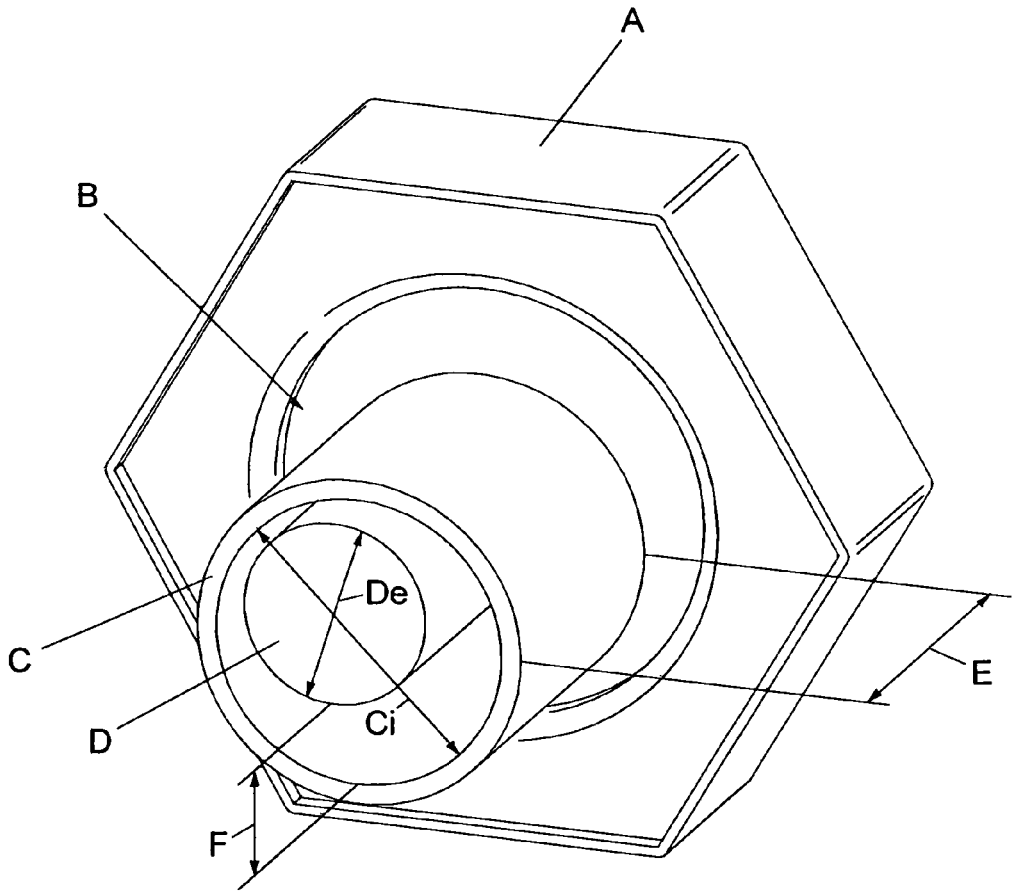
Fig. 6 PRIOR ART
FIG. 6 shows an enlarged axonometric view of a detail of a disc screen belonging to the known art.
Figure 7:
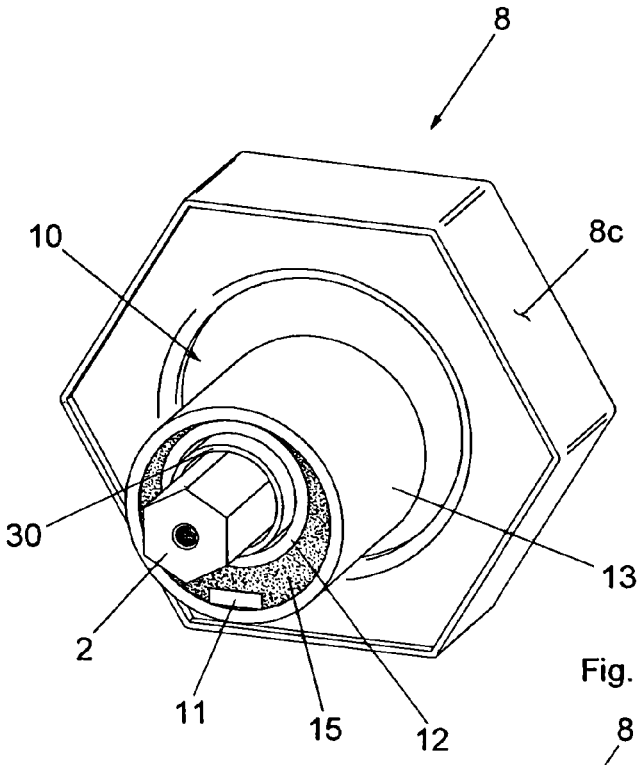
FIG. 7 shows an enlarged axonometric view of a detail of the screen of the invention.
Figure 8:
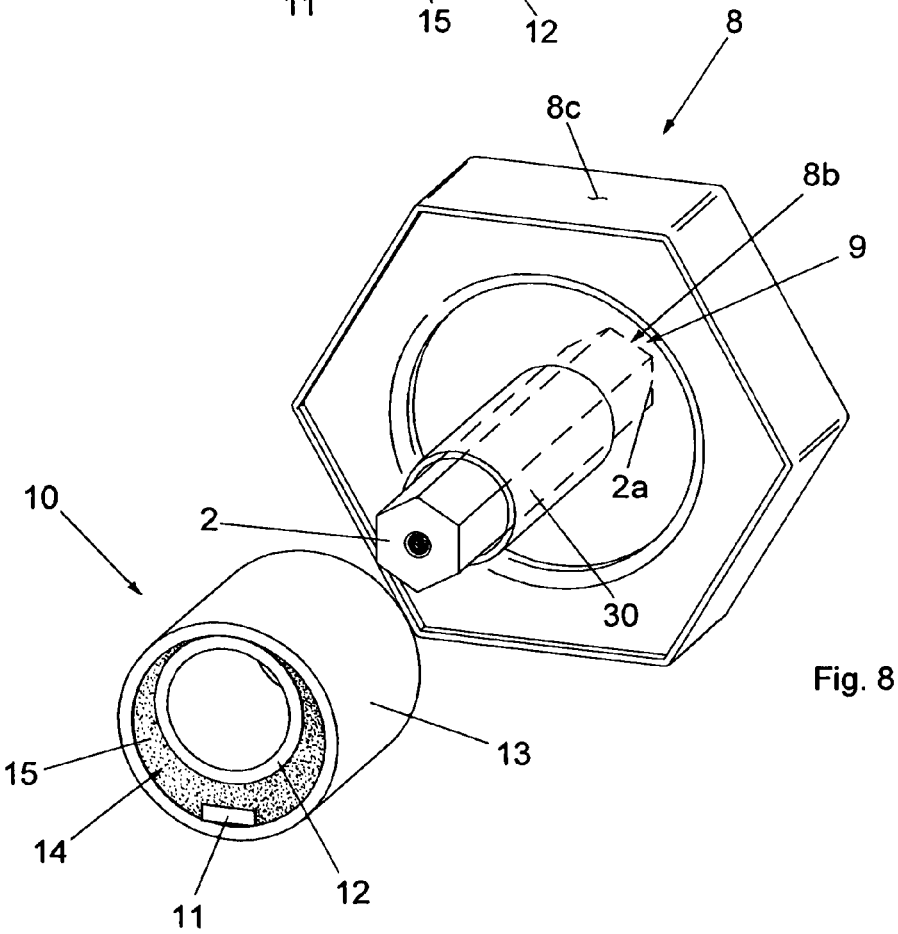
FIG. 8 shows an exploded view of the detail of FIG. 7.

It can be observed in particular in FIGS. 5, 7 and 8 that each anti-clogging sleeve 10 comprises an inner tubular body 12 coupled with a radial play outside the corresponding rotary shaft 2 and an outer tubular body 13 arranged outside the inner tubular body 12, so that between them an air space 14 is defined, in which the stabilizing body 11 is housed.

The inner tubular body 12 and the outer tubular body 13 are arranged so as to be eccentric with respect to each other and the air space 14 they define contains filling material 15 in which the stabilizing body 11 is immersed.

The inner tubular body 12 and the outer tubular body 13 have circular cross section but in different embodiments of the invention they may have oval, elliptic, polygonal or other cross sections, even in combination with each other.

Figure 9:
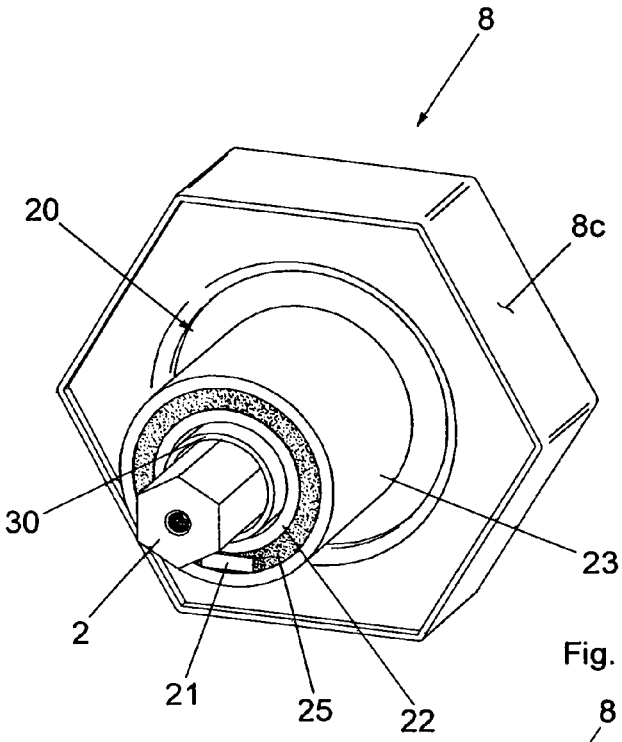
FIG. 9 shows an enlarged axonometric view of a detail of the screen of the invention according to a construction variant.
Figure 10:
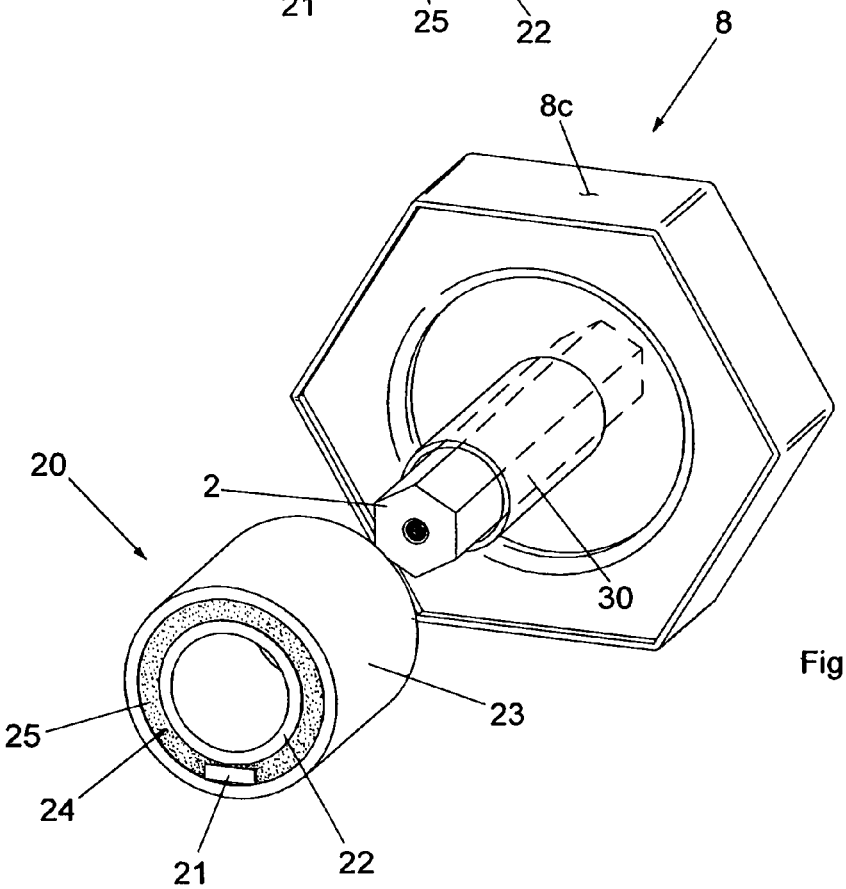
FIG. 10 shows an exploded view of the detail of FIG. 9.

According to a construction variant illustrated in FIGS. 9 and 10, the anti-clogging sleeve indicated as a whole by 20 comprises an inner tubular body 22 and an outer tubular body 23 that are coaxial to each other and the air space 24 defined by them contains the filling material 25 in which the stabilizing body 21 is immersed.

In both the embodiments it is the filling material 15, 25 that connects the tubular bodies to each other.

In any case, in other construction forms the connection between the tubular bodies 12, 13 and 22, 23 can be obtained by means of spacers positioned inside the air spaces 14, 24 or, in the embodiment with eccentric tubular bodies 12, 13, through connection means provided in the contact area.

In both the embodiments the filling material 15, 25 can be of any type, but it will preferably consist of injectable self-expanding material, for example polyurethane.

In both the embodiments it can be observed that between each pair of screening discs 8 there is a tubular sleeve 30 arranged outside the rotary shaft 2 and inside the inner tubular body 12, 22 of each anti-clogging sleeve 10, 20.

It can also be observed that the length 30*a* of each tubular sleeve 30 defines the distance 8*a* between each pair of screening discs 8 and exceeds the length 10*a*, 20*a* of each anti-clogging sleeve so as to guarantee its axial play 10*b*, 20*b* between the pair of screening discs 8 between which it is included.

In this way each anti-clogging sleeve 10, 20 can move both radially and axially in relation to the rotary shaft 2 with which it is coupled.

As already explained, each screening disc 8 has the shape of a prism with hexagonal cross section in which the plane sides 8*c* favour the advance of the residues to be screened that are pushed in the direction indicated by the arrow A.

In other embodiments of the invention the screening discs may also have external profiles with different shapes, provided that they are suited to favour the advance of the residues.

Regarding the connection means 9 that connect each screening disc 8 to the corresponding rotary shaft 2, they comprise the male shaped profile 2*a* of the cross section of each rotary shaft 2 and the female shaped profile 8*b*, conjugated to it, of the hole suited to house it that is present in each screening disc 8.

Preferably but not necessarily said shaped profiles 2*a*, 8*b* are hexagonal in shape.

Operatively, when the screen 1 of the invention is in operation, the motor 4*a*, through the chain 6 wound as a ring on the corresponding pinions 7, sets all the shafts 2 rotating in the same direction, so that the hexagonal profile with flat surface 8*c* of the screening discs 8 favours the advance of the residues that are pushed along the screening plane defined by them.

As already explained, during the advance of the materials, those whose size is smaller than the openings defined between the screening discs 8 and the anti-clogging sleeves 10, 20 fall under the screening plane by gravity, and the screening of the material according to size is thus obtained.

During the screening, the presence of the anti-clogging sleeves 10, 20 prevents or at least limits the twisting of the filiform residues around the rotary shafts 2.

In fact, the anti-clogging sleeves 10, 20 do not follow the rotary shafts 2 during rotation and do not move integrally with the waste but oscillate with a pendulum movement in relation to the vertical direction owing to the stabilizing body 11 that, when moved with respect to the vertical direction of the weight force, spontaneously tends to return to the vertical balanced position.

The invention thus achieves the object to obtain a greater anti-clogging effect than in the disc screens of known type provided with anti-clogging sleeves without stabilizing body.

In fact these, being lighter, are set rotating with respect to the rotary shafts, even if with a certain slipping effect, by the contact with the filiform residues that tend to get twisted.

In case of entanglement and twisting of filiform elements around the anti-clogging sleeves and the rotary shafts, the invention also achieves the object to allow said filiform elements to be easily removed, thanks to the fact that it is to possible to move each sleeve radially and axially with respect to the rotary shaft on which it is mounted.

According to the above, it is clear that the perfected screen of the invention achieves all the set objects.

In particular, any screen of the type with discs can be transformed in the screen of the invention by arranging the anti-clogging sleeves 10, 20 between the screening discs, said sleeves being provided with a stabilizing body and forming the subject of the invention, too.

Obviously, the inside of each anti-clogging sleeve 10, 20 can be provided with more than one stabilizing body and these can have any weight according to the needs of the user and the type of residue to be treated.

In the construction stage the screen of the invention may be subjected to changes and modifications that are neither described herein nor illustrated in the attached drawings.

Said modifications and changes must all be considered protected by the present patent, provided that they fall within the scope of the claims expressed below.

Where technical features mentioned in any claim are followed by reference signs, those reference sings have been included for the sole purpose of increasing the intelligibility of the claims and accordingly such reference signs do not have any limiting effect on the protection of each element identified by way of example by such reference signs.

The invention claimed is:

1. Perfected screen for separating solid residues, comprising:

a plurality of parallel rotary shafts spaced from each other and associated with a supporting structure;

drive means of said shafts suited to set them rotating around their longitudinal axis;

a plurality of screening discs arranged spaced from each other along said rotary shafts to which they are fixed through connection means;

a plurality of anti-clogging sleeves coupled externally to said rotary shafts and each included between two corresponding screening discs, wherein said perfected screen comprises at least one stabilizing body arranged peripherally inside each one of said anti-clogging sleeves.

2. Perfected screen according to claim 1), wherein each one of said anti-clogging sleeves comprises an inner tubular body and an outer tubular body between which an air space is defined, in which said at least one stabilizing body is housed, said inner tubular body being coupled with a radial play outside the corresponding rotary shaft.

3. Perfected screen according to claim 2), wherein said inner tubular body and said outer tubular body are coaxial with each other.

4. Perfected screen according to claim 2), wherein said inner tubular body and said outer tubular body are eccentric with respect to each other.

5. Perfected screen according to claim 2), wherein said perfected screen comprises filling material which is arranged in said air space and in which said at least one stabilizing body is immersed.

6. Perfected screen according to claim 1), wherein said perfected screen comprises a tubular sleeve interposed in axial direction between each pair of adjacent screening discs and in radial direction between the rotary shaft and an inner tubular body of the corresponding anti-clogging sleeve.

7. Perfected screen according to claim 6), wherein the length of each one of said tubular sleeves exceeds the length of each one of the inner tubular bodies, thereby providing an axial play between each anti-clogging sleeve and the pair of screening discs between which the anti-clogging screen is included.

8. Perfected screen according to claim 1), wherein each one of said connection means comprises a male shaped profile of the cross section of each one of said rotary shafts and a female shaped profile, conjugated to said male shaped profile of a hole that is present in each screening disc, suited to house said male shaped profile.

9. Perfected screen according to claim 8), wherein both said male shaped profile and said female shaped profile are hexagonal.

10. Perfected screen according to claim 1), wherein each one of said screening discs has the shape of a prism with hexagonal base.

11. Anti-clogging sleeve suited to be coaxially coupled externally to the rotary shafts of screens with discs for solid residues, wherein said anti-clogging sleeve comprises:

an inner tubular body suited to be coupled externally to said rotary shaft;

an outer tubular body arranged externally to said inner tubular body;

an air space defined between said tubular bodies, in which at least one balancing body is housed.

* * * * *